US005701876A

United States Patent [19]

Morita et al.

[11] Patent Number: 5,701,876

[45] Date of Patent: Dec. 30, 1997

[54] MISFIRE DETECTING APPARATUS FOR INTERNAL COMBUSTION ENGINE

[75] Inventors: Shingo Morita; Wataru Fukui, both of Tokyo; Shuichi Wada, Kobe, all of Japan

[73] Assignee: Mitsubishi Denki Kabushiki Kaisha, Tokyo, Japan

[21] Appl. No.: 742,893

[22] Filed: Nov. 1, 1996

[30] Foreign Application Priority Data

Jun. 10, 1996 [JP] Japan ..... 8-147538

[51] Int. Cl.[6] ..... F02P 11/00

[52] U.S. Cl. ..... 123/630

[58] Field of Search ..... 123/630, 425; 324/399

[56] References Cited

U.S. PATENT DOCUMENTS

| | | | |
|---|---|---|---|
| 5,146,893 | 9/1992 | Ohsawa | 123/425 |
| 5,189,373 | 2/1993 | Murata et al. | 324/399 |
| 5,207,200 | 5/1993 | Iwata | 123/425 |
| 5,592,926 | 1/1997 | Miyata et al. | 123/630 |
| 5,617,032 | 4/1997 | Inagaki | 324/399 |

FOREIGN PATENT DOCUMENTS

| | | | |
|---|---|---|---|
| 4-54283 | 2/1992 | Japan | 123/630 |

*Primary Examiner*—Raymond A. Nelli

*Attorney, Agent, or Firm*—Sughrue, Mion, Zinn, Macpeak & Seas, PLLC

[57] ABSTRACT

A misfire detecting apparatus for an internal combustion engine which can ensure enhanced reliability for detection of the misfire event by suppressing the so-called after-burning ion current generated in an engine cylinder controlled in precedence and superposed on a normal or regular ion current generated in a cylinder controlled in succession. The apparatus includes a bias voltage supplying means (9*a*, 9*b*) for applying a bias voltage (VBi) to the spark plugs (8*a* to 8*d*) by way of the high-voltage diodes (11*a* to 11*d*), an ion current detecting means for detecting ion currents (i) flowing through the spark plugs and an electronic control unit (2) for driving the ignition coil (4) and determining misfire event in the internal combustion engine on the basis of the ion current detection signal (Gia, Gib). The ion current detecting means includes a plurality of ion current detecting circuits for detecting ion currents in the engine cylinders belonging to a plurality of cylinder groups. The engine cylinders belonging to each cylinder group are so selected as not to be controlled in succession for ignition. In making misfire decision, the electronic control unit (2) makes use of the ion current detection signal derived from the ion current detection circuit means provided in association with the cylinder group which includes the engine cylinder currently subjected to the ignition control.

2 Claims, 6 Drawing Sheets

MISFIRE DETECTING APPARATUS FOR INTERNAL COMBUSTION ENGINE

BACKGROUND OF THE INVENTION

1. Field of the Invention

The present invention relates generally to an apparatus for detecting occurrence of misfire event in an internal combustion engine on the basis of a detected value of an ion current generated immediately after ignition control process. More specifically, the invention is concerned with a misfire detecting apparatus for an internal combustion engine which apparatus is imparted with facility or capability of detecting an intrinsic ion current with high accuracy while excluding erroneous decision of misfire event which is ascribable to false or noise ion current generated in after-burning taking place at a time point close to an exhaust stroke of the engine.

2. Description of Related Art

In general, in the internal combustion engine, an air-fuel mixture is charged into a combustion chamber defined within each of engine cylinders to be subsequently compressed in a compression stroke by a piston moving reciprocatively within the cylinder, which is then followed by application of a high voltage to a spark plug mounted in the cylinder, for thereby generating a spark between electrodes of the plug. Thus, the compressed air-fuel mixture is fired or ignited. Explosion energy resulting from the combustion is then converted into a movement of the piston in the direction reverse to that in the compression stroke, which motion is translated into a torque outputted from the internal combustion engine via a crank shaft.

When combustion of the compressed air-fuel mixture takes place within the engine cylinder, molecules prevailing within the combustion chamber are ionized. Thus, by applying a bias voltage to an ion current detecting electrode exposed on the combustion chamber, an amount of ions carrying electric charges are caused to move under the bias voltage, giving rise to an ion current flow. In that case, intensity of the ion current varies with high sensitivity in dependence on the combustion state within the combustion chamber. This in turn means that the combustion state within the engine cylinder as well as the misfire event can discriminatively be determined by detecting the behavior of the ion current.

There is known an apparatus for detecting occurrence of misfire event (i.e., unsatisfactory combustion of the air-fuel mixture) in the internal combustion engine on the basis of the detected value of the ion current, as disposed, for example, in Japanese Unexamined Patent Application Publication No. 104978/1990 (JP-A-2-104978). Further, it is well known in the art to detect the ion current by using the spark plug itself as the electrodes for detecting the ion current.

For having better understanding of the present invention, description will first be made in some detail of technical background thereof. FIG. 4 is a block diagram showing generally a configuration of a misfire detecting apparatus for an internal combustion engine known heretofore, wherein it is assumed that a high voltage is applied distributively to ignition or spark plugs of the individual engine cylinders, respectively, by way of a distributor. Further, FIGS. 5 and 6 are timing charts showing waveforms of signals appearing in the arrangement shown in FIG. 4, wherein FIG. 5 is to illustrate normal operation of a misfire detecting apparatus known heretofore while FIG. 6 is to illustrate operation thereof which suffers from an after-burning phenomenon.

Now referring to FIG. 1, provided in association with a crank shaft (not shown) of an internal combustion engine (not shown either and hereinafter referred to also as the engine) is a crank angle sensor 1 which is adapted to output a crank angle signal SGT containing a number of pulses at a frequency which depends on a rotation number or speed (rpm) of the engine.

The edges of the pulses contained in the crank angle signal SGT indicate angular reference positions for the individual engine cylinders (#1 to #4) in terms of crank angles, respectively. The crank angle signal SGT is supplied to an electronic control unit (ECU) 2 which may be constituted by a microcomputer, to be utilized for various controls and arithmetic operations involved in the controls, as will be described later on.

The reference position for the engine cylinder is usually so established that the rising edge of the pulse contained in the crank angle signal SGT makes appearance at an angular position B75° (i.e., 75° before the top dead center) in terms of the crank angle, which position corresponds to an initial power-on start timing for an ignition coil, while the falling edge of the same pulse occurs at an angular position B5° (i.e., 5° before the top dead point) which corresponds to an ignition start timing.

The electronic control unit 2 is supplied with input signals indicating operation states of the internal combustion engine which are generated by various sensors (not shown) and additionally with a cylinder identifying signal generated in synchronism with the engine rotation (rpm). The cylinder identifying signal is utilized by the electronic control unit 2 together with the crank angle signal SGT for identifying the individual engine cylinders which are under the control of the control unit 2.

The electronic control unit 2 is so designed or programmed as to carry out arithmetic operations involved in various controls on the basis of the crank angle signal SGT supplied from the crank angle sensor 1, the cylinder identifying signal and the engine operation information supplied from the various sensors, to thereby output driving signals for a variety of actuators and/or devices inclusive of an ignition coil 4.

Thus, a driving signal P generated by the electronic control unit 2 for driving the ignition coil 4 is applied to a base of a power transistor TR connected to one end of a primary winding 4*a* of the ignition coil 4, whereby a primary current i1 flowing through the primary winding 4*a* having the other end connected to a power supply source such as a battery is interrupted. As a result of this, a primary voltage V1 appearing across the primary winding 4*a* rises up steeply, whereby a secondary voltage V2 having a high voltage level (several ten kilovolts) is induced in a secondary winding 4*b* of the ignition coil 4.

A distributor 7 connected to an output terminal of the secondary winding 4*b* of the ignition coil 4 distributes the secondary voltage V2 to spark plugs 8*a*, . . . , 8*d* of the individual cylinders (#1 to #4), respectively, whereby spark discharges take place within combustion chambers defined in the engine cylinders, respectively, to trigger combustion of the air-fuel mixture confined within the combustion chamber of each cylinder.

Inserted between the one end of the primary winding 4*a* of the ignition coil 4 and the ground is a series circuit which is composed of a rectifier diode D1 connected to the one end of the primary winding 4*a*, a current limiting resistor R, a capacitor 9 connected in parallel with a voltage limiting Zener diode DZ and a rectifier diode D2, wherein the series circuit constitutes a charging current path leading to a bias voltage power supply source for detecting an ion current, as described hereinafter.

The capacitor 9 is charged to a predetermined bias voltage VBi (on the order of several hundred volts) by a charging current flowing under the primary voltage V1. Thus, the capacitor 9 serves as a bias voltage supplying source for detecting an ion current i. Immediately after the ignition control process for one of the spark plugs 8*a* to 8*d* during a later or second half of the explosion stroke), the capacitor 9 discharges through the one spark plug mentioned above, causing the ion current i to flow.

The resistor 10 inserted in a path for the ion current i between one end of the capacitor 9 and the ground constitutes an ion current detecting means for outputting an ion current detection voltage signal Ei. On the other hand, each of high-voltage diodes (i.e., diode capable of withstanding a high voltage) 11*a* to 11*d* inserted in the path for the ion current i and having respective anodes connected to the other end of the capacitor 9 has a cathode connected to one electrode of each of the spark plugs 8*a* to 8*d*.

The ion-current detection voltage signal Ei is inputted to a waveform shaping circuit 13 to be shaped so as to assume an ion current waveform Fi. The output of the waveform shaping circuit 13 is inputted to a comparison circuit 14 which then outputs a standardized or normal ion current pulse Gi to be inputted to the electronic control unit 2 as an ion current detection value or signal and utilized by the electronic control unit 2 for making decision as to occurrence of the misfire event.

Next, operation of the hitherto known misfire detecting apparatus having the circuit configuration shown in FIG. 4 will be described by reference to FIGS. 5 and 6.

Ordinarily, the electronic control unit 2 outputs a fuel injection control signal for fuel injectors and the ignition control signal P for timing on/off allowing the primary current i1 of the ignition coil 4.

Upon interruption of the primary current i1, the primary voltage V1 rising steeply makes appearance across the primary winding 4*a*, as a result of which the capacitor 9 is charged by a charging current flowing along the charging current path constituted by the rectifier diode D1, the current limiting resistor R and the rectifier diode D2. The process for charging the capacitor 9 comes to an end when the voltage appearing across the capacitor 9 has reached a reverse or backward breakdown voltage of the Zener diode DZ, which voltage corresponds to the bias voltage VBi.

On the other hand, there is induced in the secondary voltage V2 on the order of several ten kilovolts in the secondary winding 4*b* of the ignition coil 4 upon interruption of the primary current i1. This secondary voltage V2 is applied distributively to the spark plugs 8*a*, 8*d* of the individual engine cylinders, respectively, by way of the distributor 7 in the sequence of the engine cylinders #1, #3, #4 and then #2, which results in generation of the spark discharge at the spark plug within each of the combustion chambers of the engine cylinders, whereby the air-fuel mixture undergoes explosive combustion. In this manner, an output torque is generated by the internal combustion engine via the crank shaft.

Upon combustion of the air-fuel mixture, ions are generated within the combustion chamber of the engine cylinder. Thus, the ion current i can flow to the capacitor 9 under the bias voltage VBi applied to the electrodes of the spark plug. By way of example, when combustion of the air-fuel mixture takes place within the combustion chamber of the engine cylinder #1 equipped with the spark plug 8*a*, then the ion current i flows along a current path extending from the capacitor 9 to the current detecting resistor 10 through the rectifier diode 11*a* and the spark plug 8*a* in this order.

At that time, the ion current i is converted by the detection resistor 10 into a voltage signal which is outputted as the ion-current detection voltage signal Ei to be supplied to the electronic control unit 2 in the form of the ion current pulse signal Gi after having been processed in the waveform shaping circuit 13 and the comparison circuit 14, as mentioned previously. In the electronic control unit 2, decision as to occurrence of misfire in the engine cylinder under the control is made on the basis of presence/absence of the ion current pulse signal Gi, the timing at which the ion current pulse rises up and/or the pulse width of the ion current pulse.

So long as the engine operation state inclusive of the combustion within the engine cylinder is normal (refer to FIG. 5), the air-fuel mixture within the engine cylinder which is in the compression stroke is fired by the spark discharge generated at the spark plug of that cylinder to undergo the explosive combustion. Such ignition control is performed successively for the individual cylinders #1, #3, #4 and #2 in this order. Further, in the four-cycle internal combustion engine, the control process for each of the individual engine cylinders is repetitively effected in the sequence of the suction stroke, compression stroke, explosion stroke and then the exhaust stroke, being shifted one by one.

Accordingly, the electronic control unit 2 detects a series of normal ion current pulses Gi corresponding to the individual spark plugs 8*a* to 8*d*, respectively, while identifying discriminatively the cylinder which is currently controlled in respect to the fuel injection and the ignition timing.

However, when the internal combustion engine operates in a high-speed range, the aforementioned strokes in each cylinder shifts from one to another at a relatively shorter time interval when compared with the time taken for the combustion of air-fuel mixture in each cylinder. Consequently, the combustion or burning of the air-fuel mixture may be sustained even at a time point closer to the exhaust stroke which succeeds to the ignition/explosion process. This phenomenon is referred to as the after-burning.

Under the circumstances, when the after-burning phenomenon occurs in a cylinder for which the ignition/combustion process has been controlled immediately in precedence to the ignition timing for another cylinder which is now or currently to be controlled, then an ion current of a waveform fi generated due to the after-burning (hereinafter referred to as the after-burning ion current waveform fi) will be superposed on a normal ion current waveform Fi generated in the explosion stroke of the cylinder which is currently controlled, as a result of which the after-burning ion current pulse signal gi is inputted to the electronic control unit 2 in combination with the normal ion current pulse Gi.

More specifically, the genuine or intrinsic ion current of the waveform Fi generated in the cylinder #1 upon ignition/combustion control will be superposed with the spurious ion current of the waveform fi originating in the after-burning in the cylinder #2 undergone the ignition/combustion control in precedence, while the ion current waveform Fi generated upon ignition/combustion control of the cylinder #3 will be superposed with the after-burning ion current of the waveform fi generated in the cylinder #1 and so forth. Thus, the normal or intrinsic ion current pulse Gi is ultimately superposed with the after-burning ion current pulse In this manner, when the ion current pulse Gi generated in the regular combustion is detected together with the after-burning ion current pulse gi superposed, the electronic control unit 2 may detect the after-burning ion current pulse gi erroneously as the normal ion current pulse Gi even in the case where the normal ion current pulse Gi is not generated due to occurrence of misfire. In other words, the misfire is not detected by the electronic control unit 2 but a normal combustion state is decided by the latter.

As an attempt for preventing or suppressing such erroneous misfire decision as mentioned above, it may be conceived to provide the ion current detecting means in one-to-one correspondence to the individual engine cylinders. In that case, however, not only the circuit configuration of the misfire detecting apparatus becomes complicated but also the amount of hardware increases, incurring high manufacturing cost.

As will now be appreciated from the foregoing, in the conventional misfire detecting apparatus for the internal combustion engine in which the ion current pulses Gi are detected with the aid of the single ion current detecting circuit comprised of the capacitor 9 and the detecting resistor 10, such serious problem will be encountered particularly in a high-speed operation range of the engine that the ion current pulse gi originating in the after-burning in the cylinder controlled in precedence is detected as being superposed or in the vicinity of the ion current pulse Gi generated in the normal combustion in the cylinder undergone currently the ignition/combustion control (see FIG. 6), as a result of which misfire taking place in the cylinder controlled currently can not be detected as the misfire, whereby the reliability for the misfire detection may significantly be impaired.

The above problem may certainly be solved by providing a plurality of ion current detecting means for the engine cylinders, respectively, in one-to-one correspondence. However, in that case, the manufacturing cost of the misfire detecting apparatus will increase remarkably, giving rise to another problem.

SUMMARY OF THE INVENTION

In the light of the state of the art described above, it is contemplated with the present invention to solve the problems of the hitherto known misfire detecting apparatus described above.

Thus, it is an object of the present invention to provide a misfire detecting apparatus for an internal combustion engine, which apparatus can ensure enhanced reliability for detection of the misfire event by suppressing the so-called after-burning ion current generated in an engine cylinder controlled in precedence and superposed on a normal or regular ion current.

In view of the above and other objects which will become apparent as the description proceeds, there is provided according to a general aspect of the present invention a misfire detecting apparatus for an internal combustion engine including a plurality of engine cylinders, which apparatus includes a crank angle sensor means for generating a crank angle signal containing pulses each having an a pulse edge corresponding to a reference crank angle position in synchronism with rotation of the internal combustion engine, spark plugs mounted in the engine cylinders, respectively, an ignition coil for applying a high firing voltage to the spark plugs for igniting an air-fuel mixture within the associated engine cylinders, respectively, a plurality of high-voltage diodes connected to one ends of the spark plugs, respectively, for applying a bias voltage to the spark plugs with a same polarity as that of the firing voltage, a bias voltage supplying means for applying a bias voltage to the spark plugs by way of the high-voltage diodes, an ion current detecting means including the bias voltage supplying means for detecting ion currents flowing through the spark plugs under application of the bias voltage immediately after ignition control, to thereby output ion current detection signals for said cylinders, respectively, and an electronic control unit for driving the ignition coil on the basis of the crank angle signal and determining occurrence of misfire event in the internal combustion engine on the basis of the ion current detection signal. The ion current detecting means includes a first ion current detecting circuit means for detecting ion currents in the engine cylinders belonging to a first cylinder group, and a second ion current detecting circuit means for detecting ion currents in the engine cylinders belonging to a second cylinder group. The engine cylinders belonging to each of the first and second cylinder groups are so selected as not to be controlled in succession for ignition. Further, the electronic control unit is adapted to use the ion current detection signal derived from the ion current detection circuit means provided in association with the cylinder group which includes the engine cylinder currently subjected to the ignition control.

By virtue of the arrangement of the misfire detecting apparatus described above, the spurious ion current originating in the after-burning in the cylinders controlled in precedence can positively be prevented from being superposed on the intrinsic ion current generated in the cylinder controlled currently, whereby the erroneous detection of misfire event can positively be excluded with simple and inexpensive structure of the misfire detecting apparatus. Thus, there can be implemented the misfire detecting apparatus for the internal combustion engine which can ensure significantly enhanced reliability for the misfire detection.

In a preferred mode for carrying out the invention, the electronic control unit may so designed as to set a temporal period extending from a first pulse edge to a second pulse edge of the pulses contained in the crank angle signal and corresponding to an explosion stroke in the cylinder subjected to the ignition control as a period during which detection of misfire on the basis of the ion current detection signal is enabled.

With the arrangement of the misfire detecting apparatus described above, noise components can positively be excluded from the intrinsic ion current, whereby reliability for the misfire detection can further be enhanced.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which.

DESCRIPTION OF THE PREFERRED EMBODIMENTS

Figure 1:
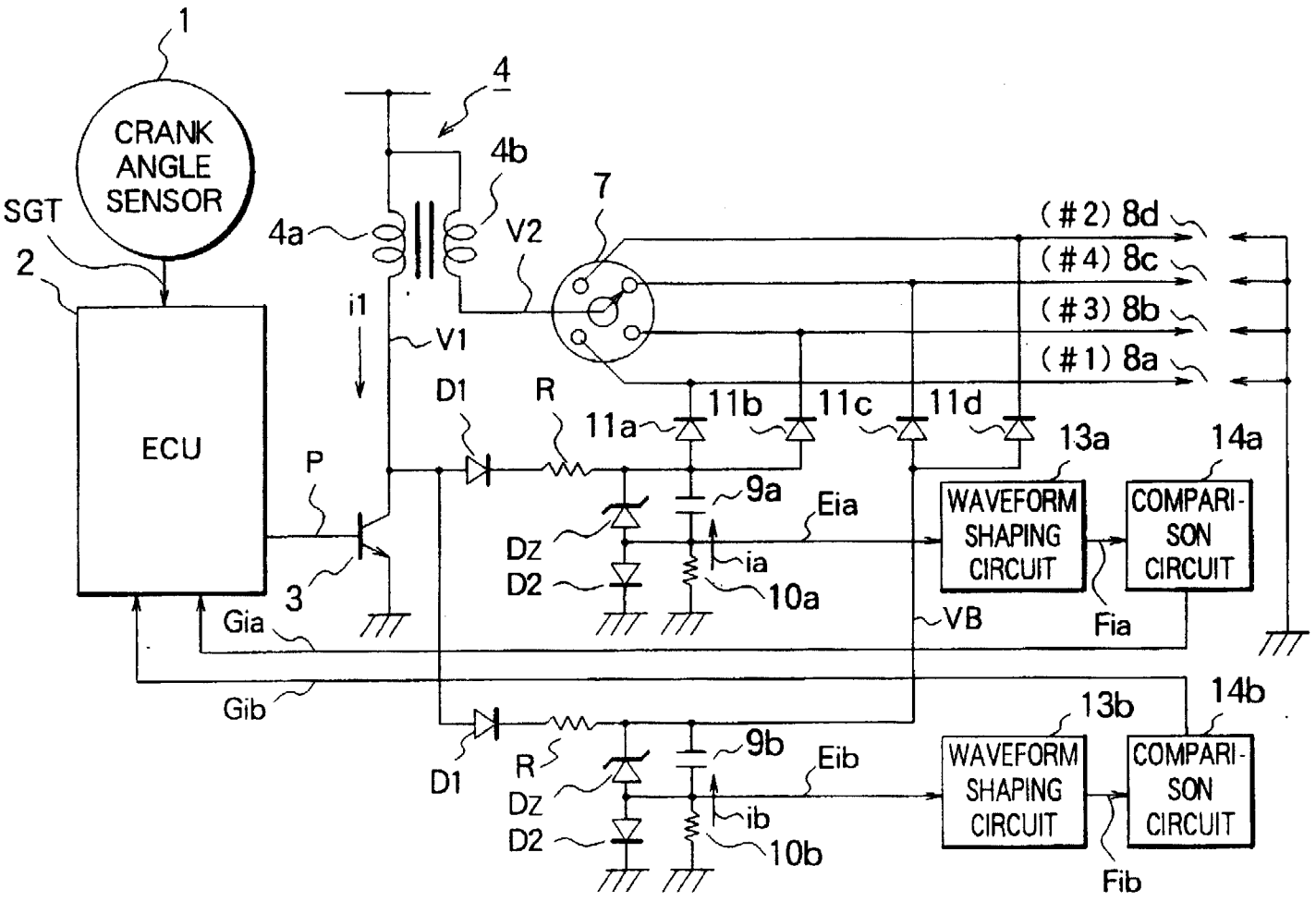
FIG. 1 is a schematic circuit diagram showing a structure of a misfire detecting apparatus according to a first embodiment of the present invention.

Now, the present invention will be described in detail in conjunction with what is presently considered as preferred or typical embodiments thereof by reference to the drawings. In the following description, like reference characters designate like or equivalent components parts throughout the several views.

Embodiment 1

Figure 4:
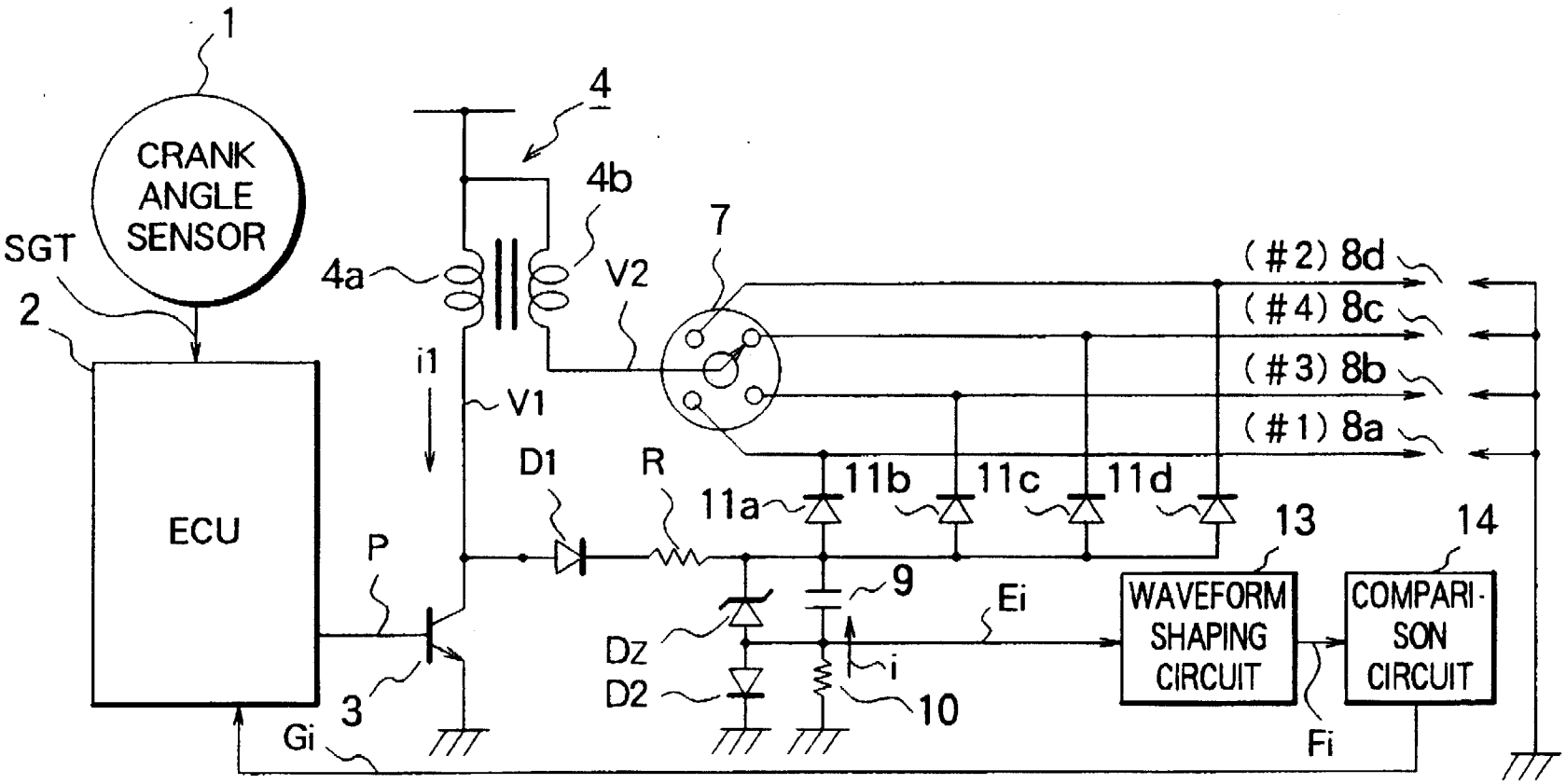
FIG. 4 is a schematic circuit diagram showing a structure of a hitherto known misfire detecting apparatus for an internal combustion engine.

FIG. 1 is a schematic circuit diagram showing a structure of the misfire detecting apparatus according to a first embodiment of the present invention. In the figure, components same as or equivalent to those described hereinbefore by reference to FIG. 4 are denoted by like reference characters and repetitive description thereof will be omitted.

According to the teaching of the invention incarnated in the first embodiment thereof, there are provided a pair of ion current detecting circuits implemented in an essentially same circuit configuration and connected in parallel with each other, wherein a first ion current detecting circuit is provided in association with a first cylinder group including those cylinders for which the ignition control is performed in a discontinuous sequence, as exemplified by the cylinders #1 and #4, while a second ion current detecting circuit is provided in association with a second cylinder set or group including other cylinders for which the ignition control is performed in a discontinuous sequence, as typified by the cylinders #3 and #2, wherein the first ion current detecting circuit is so designed as to generate first ion current pulse signal Gia for the cylinders #1 and #4 belonging to the first cylinder group while the second ion current detecting circuit is so implemented as to generate a second ion current pulse signal Gib for the cylinders #3 and #2 belonging to the second cylinder group independent of the first ion current pulse Gia.

Referring to FIG. 1, the first ion current detecting circuit is comprised of a series connection of a capacitor 9a and a detecting resistor 10a, a waveform shaping circuit 13a and a comparison circuit 14a, while the second ion current detecting circuit is constituted by a series connection of a capacitor 9b and a detecting resistor 10b, a waveform shaping circuit 13b and a comparison circuit 14b.

The spark plugs 8a and 8c of the cylinders #1 and #4, respectively, are connected to the capacitor 9a incorporated in the first ion current detecting circuit by way of high-voltage diodes 11a and 11c, respectively, so as to be applied with a bias voltage VBi from the capacitor 9a.

On the other hand, the spark plugs 8b and 8d of the cylinders #3 and #2, respectively, are connected to the capacitor 9b incorporated in the second ion current detecting circuit by way of high-voltage diodes 11b and 11d, respectively, so as to be applied with a bias voltage VBi from the capacitor 9b.

Thus, an ion current ia generated in the cylinders #1 and #4 (i.e., in the cylinders belonging to the first cylinder group) is detected as an ion-current detection voltage signal Eia (see FIG. 1) by the detecting resistor 10a incorporated in the first ion current detecting circuit to be thereby fed to the electronic control unit 2 as a first ion current pulse signal Gia (see FIG. 2) by way of the waveform shaping circuit 13a and the comparison circuit 14a.

Further, an ion current ib generated in the cylinders #3 and #2 (i.e., in the cylinders belonging to the second cylinder group) is detected as an ion-current detection voltage signal Eib (see FIG. 1) by the detecting resistor 10b incorporated in the second ion current detecting circuit to be thereby fed to the electronic control unit 2 as a second ion current pulse signal Gib (see FIG. 2) by way of the waveform shaping circuit 13b and the comparison circuit 14b.

Owing to the arrangement described above, the ion currents flowing in the engine cylinders which are controlled successively or continuously with regard to the ignition process are detected alternately as the ion-current detection voltage signals Eia and Eib by the first and second ion current detecting circuits, respectively, to be made available as the ion current pulse-like signals Fia and Fib, and the ion current pulse signals Gia and Gib, respectively.

Figure 2:
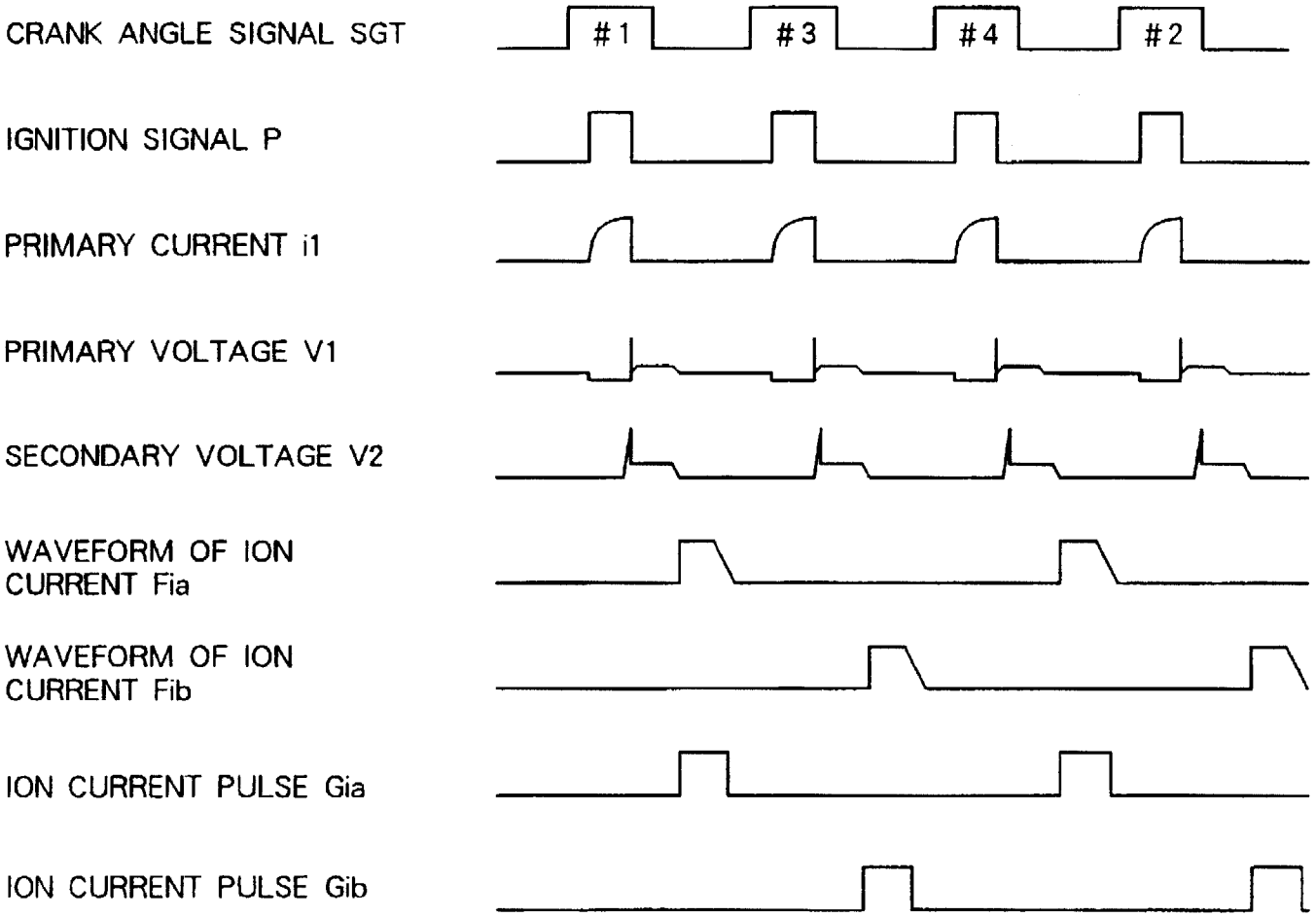
FIG. 2 is a timing chart for illustrating operation of the misfire detecting apparatus shown in FIG. 1 in the case where combustion state is normal.
Figure 3:
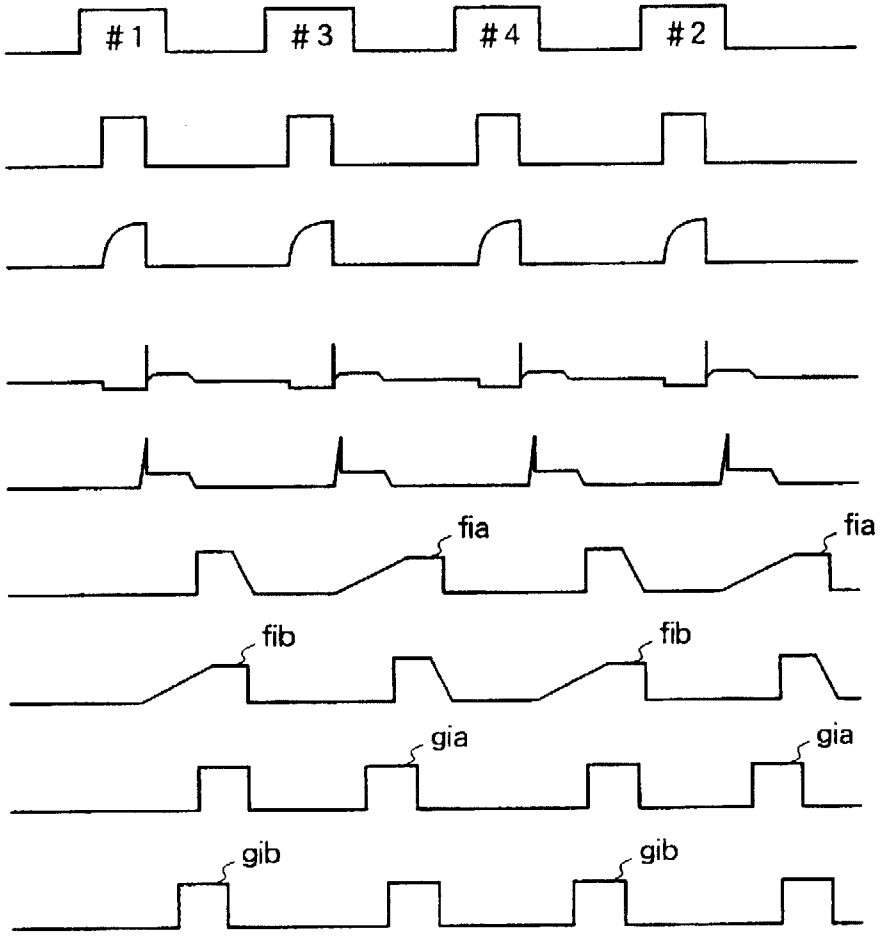
FIG. 3 is a timing chart for illustrating operation of the misfire detecting apparatus shown in FIG. 1 in the case where an after-burning phenomenon occurs.

FIGS. 2 and 3 are timing charts showing waveforms of signals generated in the arrangement shown in FIG. 1, wherein FIG. 2 is to illustrate normal operation, while FIG. 3 is to illustrate operation suffering an after-burning phenomenon.

Next, operation of the misfire detecting apparatus for the internal combustion engine according to the first embodiment of the invention shown in FIG. 1 will be described by reference to FIGS. 2 and 3.

As described above, one of the ion current detecting circuits (first ion current detecting circuit) generates the first ion current pulse signal Gia (FIG. 2) upon every detection of the ion currents generated at the spark plugs 8a and 8c of the cylinders #1 and #4, respectively, while the other or second ion current detecting circuit generates the second ion current pulse signal Gib (see FIG. 2) upon every detection of the ion currents generated at the spark plugs 8b and 8d of the cylinders #3 and #2, respectively, the ignition process for which is controlled by the electronic control unit 2 in succession to the ignition control for the cylinders #1 and #4, respectively.

Figure 5:
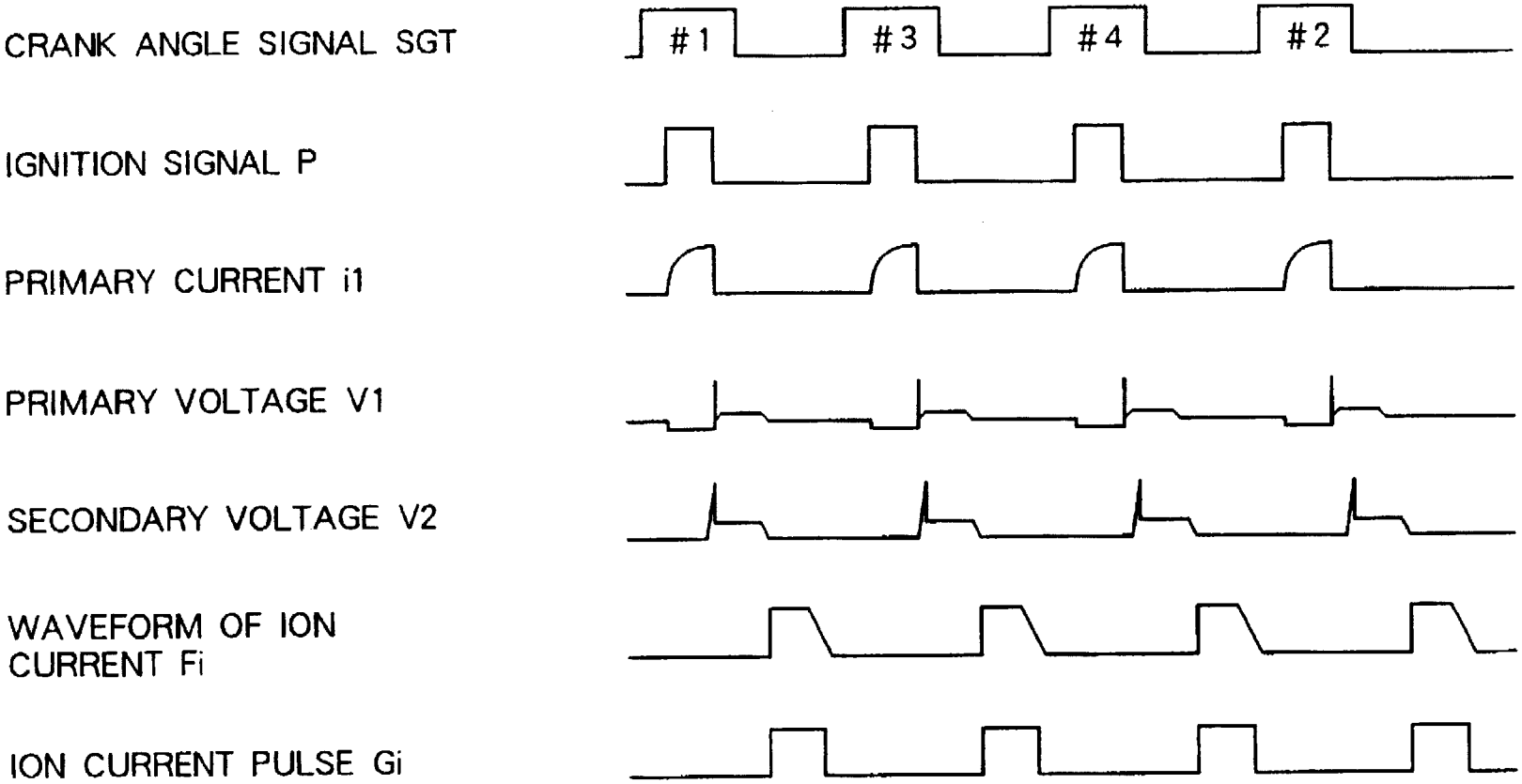
FIG. 5 is a timing chart for illustrating operation of the misfire detecting apparatus shown in FIG. 4 in the case where the combustion state is normal.
Figure 6:
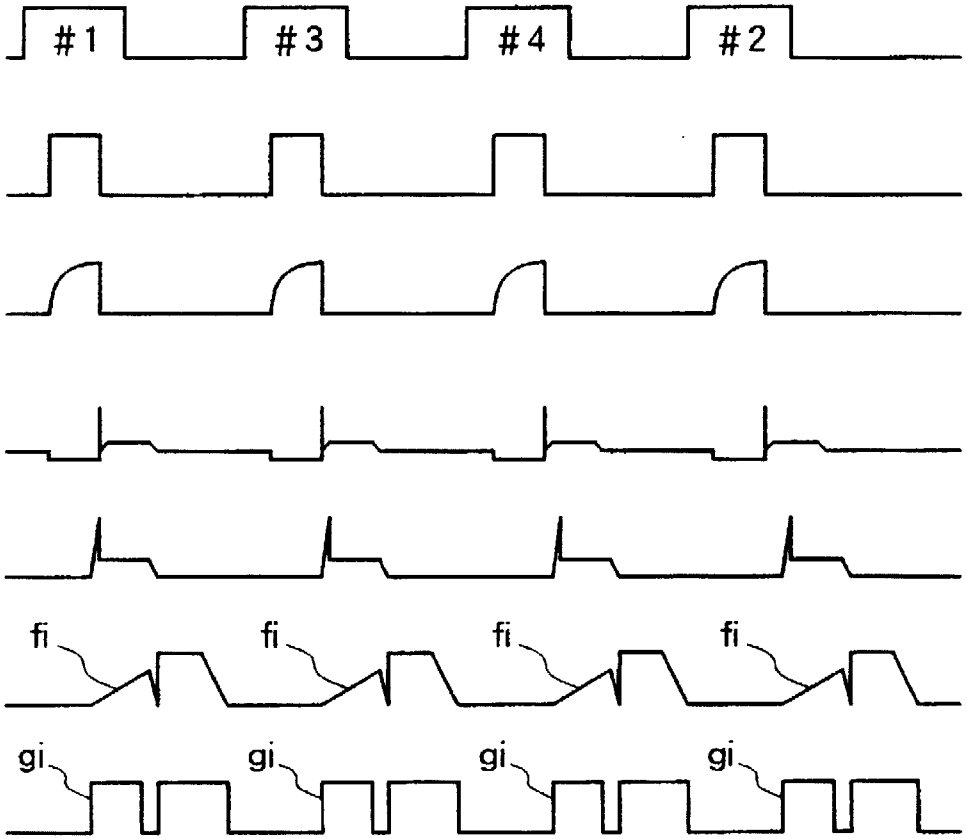
FIG. 6 is a timing chart for illustrating operation of the misfire detecting apparatus shown in FIG. 4 in the case where an after-burning phenomenon takes place.

In that case, the cylinders #1 and #4 on one hand and the cylinders #3 and #2 on the other hand bear a symmetrical relation to each other in respect to the operation stroke. By way of example, when one of cylinders #1 and #4 (or one of the cylinders #3 and #2) is in the compression stroke, the other cylinder #1 or #4 (#3 or #2) is in the exhaust stroke. Thus, any one of both the ion current detecting circuits mentioned previously cannot generate the first ion current pulses Gia or second ion current pulses Gib in succession or continuously. Compare FIG. 2 with FIG. 5.

Consequently, the detecting resistors 10a and 10b incorporated in the first and second ion current detecting circuits output alternately the ion-current detection voltage signals Eia and Eib on the basis of the ion currents ia and ib for both the cylinder groups, respectively.

The ion-current detection voltage signals Eia and Eib undergo the signal processing, whereby the ion current pulses Gia and Gib are generated alternately with each other, as illustrated in FIG. 2.

On the other hand, when the after-burning phenomenon takes place, the after-burning ion currents having such waveforms fia add fib which are generated due to the after-burning are applied alternately to the pair of the ion current detecting circuits (see FIG. 3). Accordingly, the after-burning ion current waveforms fia and fib ascribable to the after-burning taking place currently are prevented from being superposed on the normal ion current ia during the misfire detection periods for the engine cylinders which are to next undergo the ignition control, (i.e., during a second half of the explosion stroke thereof), as can be seen from FIG. 3.

In other words, because the ion current detecting intervals for the engine cylinders for which the ignition control is performed successively or continuously are separated discretely from each other by the pair of the ion current detecting circuits, the after-burning ion currents of the waveforms fia and fib which should not be detected will be generated at a mid time point between the misfire detecting time points for the engine cylinders, respectively, while belonging to the cylinder groups, respectively. In this way, the after-burning ion current waveforms fia and fib can be separated definitely and discretely from the normal or intrinsic ion current pulses Gia, Gib.

Thus, the electronic control unit 2 can monitor or supervise the state of the cylinders controlled currently on the basis of the crank angle signal SGT and other parameter to thereby make decision as to occurrence of misfire event on the basis of only the ion current pulse corresponding to the cylinder Groups each including the engine cylinders for which the ignition control is performed currently, while neglecting separated the after-burning ion current pulse of the waveform fia or fib. In this way, the misfire detection can be performed with high reliability on the basis of only the normal ion current pulses Gia and Gib.

Embodiment 2

In the case of the misfire detecting apparatus according to the first embodiment of the invention, the ion current detection is performed for the cylinder groups alternately with each other by employing a pair of ion current detecting circuits so that the after-burning ion current pulses gia and gib are separated from the normal ion current pulses Gia and Gib, i.e., the misfire detection is not performed for the cylinders for which the ignition is controlled in succession. However, in consideration of the fact that the ion current i is Generated during a time period in which the crank angle signal SGT is at low level ("L"), the ion current detecting interval may be so selected or set that it falls within the period in which the crank angle signal SGT is at the level "L".

Thus, according to the teaching of the invention incarnated in a second embodiment thereof, the period during which the crank angle signal SGT is at level "L" is previously set as a period during which the electronic control unit 2 is enabled to make decision as to occurrence of the misfire by taking into account that the ion current owing to the normal combustion is generated in the explosion stroke of the internal combustion engine and that the period at which the crank angle signal SGT is at level "L"πcorresponds to the explosion stroke in each of the engine cylinders.

Owing to the arrangement mentioned above, the ion current and other noise or spurious current components can not be detected from any other engine cylinders than the one which is currently subjected to the ignition control, whereby the ion current pulses Gia and Gib which are immune to various noise or spurious signal components can be obtained positively. Thus, the misfire detection can be performed with higher reliability.

Modifications

Many features and advantages of the present invention are apparent from the detailed description and thus it is intended by the appended claims to cover all such features and advantages of the system which fall within the true spirit and scope of the invention. Further, since numerous modifications and combinations will readily occur to those skilled in the art, it is not intended to limit the invention to the exact construction and operation illustrated and described.

By way of example, in the misfire detecting apparatus case of the according to the second embodiment of the invention described above, the period of level "L" which extends from the falling edge to the rising edge of the crank angle pulse SGT is set as the interval for the ion current detection. It goes however without saying that when the crank angle signal SGT is of reverse polarity, the period during which the crank angle signal SGT assumes high level "H" is set as the interval for the ion current detection.

In the foregoing description directed to the first and second embodiments of the invention, it has been assumed that the secondary voltage V2 for the ignition and the bias voltage VBi are of positive (or plus) polarity. However, when these voltages are of negative (minus) polarity, the high-voltage diodes 11*a* to 11*d* and others will have to be inserted with the reverse polarity, needless to say.

Furthermore, in the misfire detecting apparatus according to the first and second embodiments of the invention, description has been made on the assumption that the internal combustion engine of concern includes four cylinders, wherein the individual cylinders for the ion current detection are groupwise classified into the first cylinder group (including the cylinders #1 and #4) and the second cylinder group (including the cylinders #3 and #2) for which two separated ion current detecting circuits are provided, respectively. It should however be mentioned that the number of the cylinders as well as that of the ion current detecting circuits may be selected rather arbitrarily as occasion requires. To say in another way, the invention can equally find application to an internal combustion engine including a given number of cylinders in general. In that case, the individual cylinders may be classified into a number of cylinder groups by taking into account the ratio of the combustion time duration in the cylinder to the engine rotation speed (rpm), and a corresponding number of the ion current detecting circuits may be provided in association with the cylinder groups, respectively, in one-to-one correspondence.

Furthermore, although the invention has been described in conjunction with the ignition system in which a high voltage is distributed to the spark plug 8*a*, . . . , 8*d* from the secondary winding 4*b* of the ignition coil 4 by way of the distributor 7, the invention is never limited to any particular voltage distribution system or scheme. The invention can equally be applied to other type ignition systems including a direct ignition system, a low-voltage system and the like.

Accordingly, all suitable modifications and equivalents may be resorted to, falling within the spirit and scope of the invention.

What is claimed is:

1. A misfire detecting apparatus for an internal combustion engine including a plurality of engine cylinders, comprising:

crank angle sensor means for generating a crank angle signal with a pulse edge corresponding to a reference crank angle position in synchronism with rotation of said internal combustion engine;

spark plugs mounted in said engine cylinders, respectively;

an ignition coil for applying a high firing voltage to said spark plugs for igniting an air-fuel mixture within the associated engine cylinders, respectively;

a plurality of high-voltage diodes connected to first ends of said spark plugs, respectively, for applying a bias voltage to said spark plugs with a same polarity as that of the firing voltage;

bias voltage supplying means for applying a bias voltage to said spark plugs by way of said high-voltage diodes;

ion current detecting means including said bias voltage supplying means for detecting ion currents flowing through said spark plugs under application of said bias voltage immediately after ignition control, to thereby output ion current detection signals for said cylinders, respectively; and an electronic control unit for driving said ignition coil on the basis of said crank angle signal and determining an occurrence of a misfire event in said internal combustion engine on the basis of said ion current detection signal, wherein said ion current detecting means includes:

first ion current detecting circuit means for detecting ion currents for engine cylinders belonging to a first cylinder group; and second ion current detecting means for detecting ion currents for engine cylinders belonging to a second cylinder group;

wherein engine cylinders belonging to the respective first and second cylinder groups are selected so as not to be controlled in succession for ignition; and said electronic control unit being adapted to use the ion current detection signal derived from the ion current detection circuit means provided in association with the cylinder group which includes the engine cylinder currently subjected to ignition control.

2. A misfire detecting apparatus in an internal combustion engine according to claim 1, wherein said electronic control unit sets a temporal period extending from a first pulse edge to a second pulse edge of the pulses contained in said crank angle signal and corresponding to a combustion stroke in the cylinder subjected to ignition control as a period during which detection of misfire on the basis of said ion current detection signal is enabled.

* * * * *